US012264556B1

(12) United States Patent
Almukhlifi et al.

(10) Patent No.: US 12,264,556 B1
(45) Date of Patent: Apr. 1, 2025

(54) LOW PRESSURE STARTER WELLHEAD SYSTEM AND METHOD OF ASSEMBLY FOR OIL AND GAS APPLICATIONS

(71) Applicant: SAUDI ARABIAN OIL COMPANY, Dhahran (SA)

(72) Inventors: Mohammed Eid Almukhlifi, Dhahran (SA); Abdulrhman Al-Hashim, Dhahran (SA); Pandu Wirawan, Dhahran (SA); Mohammed K. Muqri, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/423,078

(22) Filed: Jan. 25, 2024

(51) Int. Cl.
*E21B 34/02* (2006.01)
*E21B 33/068* (2006.01)

(52) U.S. Cl.
CPC ..... *E21B 34/02* (2013.01); *E21B 33/068* (2013.01)

(58) Field of Classification Search
CPC ..... E21B 34/02; E21B 33/068
See application file for complete search history.

(56) References Cited

U.S. PATENT DOCUMENTS 4,503,879 A * 3/1985 Lazarus ..... F16L 55/128 138/94
4,512,410 A 4/1985 Forester
4,541,490 A 9/1985 Bigbie et al.
5,076,356 A 12/1991 Reimert
5,544,707 A * 8/1996 Hopper ..... E21B 33/043 166/368
7,823,634 B2 * 11/2010 Chan ..... E21B 43/26 166/80.1
8,118,090 B2 2/2012 Dallas et al.
9,388,655 B2 7/2016 Sommerfeld et al.
9,835,009 B2 12/2017 Hess et al.
10,487,587 B2 11/2019 Cummins
11,396,785 B2 * 7/2022 Mukhlifi ..... E21B 33/047
11,519,237 B2 12/2022 Holmes et al.
2003/0205385 A1 * 11/2003 Duhn ..... E21B 33/068 166/380

(Continued)

FOREIGN PATENT DOCUMENTS

CA 2338097 A 2/2001

*Primary Examiner* — James G Sayre
(74) *Attorney, Agent, or Firm* — Vorys, Sater, Seymour and Pease LLP

(57) ABSTRACT

A well system includes a wellhead installation positioned above and extending over a wellbore, the wellhead installation including a low pressure wellhead (LPWH) providing a body having opposing upper and lower ends, and an internal through-bore defined within the body and extending between the upper and lower ends, two or more fluid outlets defined through a sidewall of the body to facilitate fluid communication with the internal through-bore, and a load shoulder defined within the internal through-bore axially uphole from the two or more fluid outlets. Conductor casing is secured to the lower end of the body of the LPWH, and a casing hanger is operatively coupled to an extension of casing and extends concentrically within the conductor and into the wellbore, the casing hanger defining a hanger shoulder engageable with the load shoulder when the casing hanger is lowered into the LPWH.

18 Claims, 5 Drawing Sheets

(56) References Cited

U.S. PATENT DOCUMENTS

| | | | | |
|---|---|---|---|---|
| 2013/0014947 | A1* | 1/2013 | Wilkins | E21B 43/26 166/281 |
| 2013/0025848 | A1* | 1/2013 | Schepp | E21B 33/06 166/85.1 |
| 2014/0299328 | A1* | 10/2014 | Ray | E21B 34/04 166/360 |
| 2023/0008109 | A1* | 1/2023 | Sneed | E21B 33/04 |
| 2023/0212922 | A1 | 7/2023 | Wright et al. | |

* cited by examiner

LOW PRESSURE STARTER WELLHEAD SYSTEM AND METHOD OF ASSEMBLY FOR OIL AND GAS APPLICATIONS

FIELD OF THE DISCLOSURE

The present disclosure relates generally to wellheads in the oil and gas industry and, more particularly, to low pressure wellhead housing systems that can accommodate large diameter casings and casing thermal expansion.

BACKGROUND OF THE DISCLOSURE

Wellheads are a required and essential component for every oil and gas well drilled and completed for production. The wellhead provides a sealed barrier between the wellbore and the atmosphere and, in addition, provides load support for each tubular extended into the wellbore. The wellhead also facilitates production of downhole fluids as the wellhead is the connection point from the downhole tubulars to the surface production equipment.

Large diameter casings (e.g., conductor casing or similarly, drive pipe) are the first casings installed when constructing a wellbore and are primarily set in the shallowest portions of the formation to prevent wellbore collapse. Once set, the large diameter casing(s) often serve primarily as load support for the subsequent wellhead housings that will be installed as the wellbore is drilled to deeper depths. In this capacity, generally, the large diameter casings have no fluid communication with the subsequent wellhead housings, and thus, there is no way to ensure sealing integrity in the annulus defined between the large diameter casing and the subsequent casing string(s) concentrically arranged within the large diameter casing.

As a result, the need to ensure a robust seal in the annuli of the large diameter casings to prevent the outflow of fluids from the interior of the well (e.g., drilling fluids, produced hydrocarbons, etc.) to the atmosphere is critical. Similarly, as formations comprising shallow gas, shallow water flows and/or any other shallow hazard are explored more frequently, a durable annular barrier and/or seal operable to prevent the influx of such shallow hazard fluids into the well is also highly valuable.

Another wellhead concern is thermal expansion. Casings installed within a wellbore will generally be subject to thermal expansion cycles, which may trigger wellhead axial movement.

Accordingly, a well system that incorporates large diameter casings with sealed and testable annuli and that is operable to withstand thermal expansion cycles, is integral to a successful, producible wellbore.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a well system may include a wellbore penetrating a subterranean formation and a wellhead installation positioned above and extending over the wellbore. The wellhead installation may including a low pressure wellhead (LPWH) providing a body having opposing upper and lower ends, and an internal through-bore defined within the body and extending between the upper and lower ends. The LPWH may include two or more fluid outlets defined through a sidewall of the body to facilitate fluid communication with the internal through-bore and a load shoulder defined within the internal through-bore axially uphole from the two or more fluid outlets. The well system may further include a conductor casing secured the lower end of the body of the LPWH and a casing hanger operatively coupled to an extension of casing extending concentrically within the conductor and into the wellbore, the casing hanger may define a hanger shoulder engageable with the load shoulder when the casing hanger is lowered into the LPWH.

According to an embodiment consistent with the present disclosure, a well system may include a wellbore penetrating a subterranean formation and a wellhead installation positioned above and extending over the wellbore. The wellhead installation may include a low pressure wellhead (LPWH) providing a body having opposing upper and lower ends, and an internal through-bore defined within the body and extending between the upper and lower ends. The LPWH may include two or more fluid outlets defined through a sidewall of the body to facilitate fluid communication with the internal through-bore and a load shoulder defined within the internal through-bore axially uphole from the two or more fluid outlets and a tapered shoulder defined within the internal through-bore axially uphole from the load shoulder. The well system may further include a conductor casing secured to the lower end of the body of the LPWH and a contingency landing joint operatively coupled to an extension of casing extending concentrically within the conductor and into the wellbore as well as a centralizer ring arranged about an exterior of the contingency landing joint and engageable with the tapered shoulder wherein landing the centralizer ring on the tapered shoulder supports the contingency landing joint and the extension of casing within the LPWH.

According to an embodiment consistent with the present disclosure, a method of installing a wellhead installation may include positioning a low pressure wellhead (LPWH) on a terranean surface extending over and around a wellbore penetrating a subterranean formation. The LPWH may include a body having opposing upper and lower ends and an internal through-bore defined within the body and extending between the upper and lower ends. The LPWH may further include two or more fluid outlets defined through a sidewall of the body to facilitate fluid communication with the internal through-bore and a load shoulder defined within the internal through-bore axially uphole from the two or more fluid outlets. The method may include lowering an extension of casing operatively coupled to a casing hanger into the wellbore through the LPWH until a hanger shoulder defined on the casing hanger engages the load shoulder and supporting the casing within the LPWH and the wellbore with the hanger shoulder engaged against the load shoulder.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1:
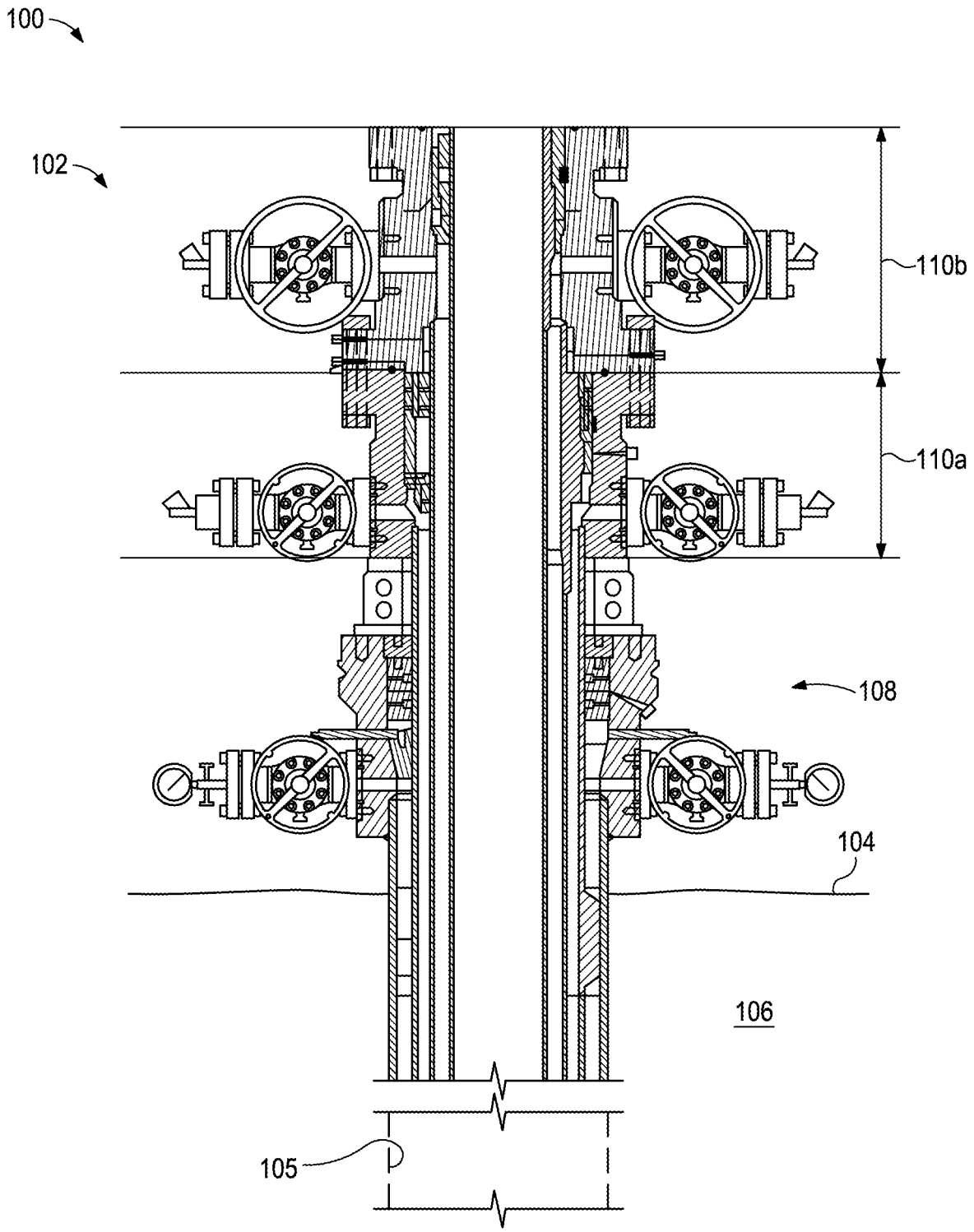
FIG. 1 is a schematic diagram of an example wellhead system that may incorporate the principles of the present disclosure.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been apparent to one of ordinary skill in the art that the scale of the elements presented in the accompanying Figures may vary without departing from the scope of the present disclosure.

Embodiments in accordance with the present disclosure generally relate to wellheads in the oil and gas industry and, more particularly, to a low pressure wellhead housing system that can accommodate large diameter casings as well as thermal expansion of the casings, which may occur once the well begins to produce hydrocarbons. Specifically, the wellheads disclosed herein include a system of housings and assemblies that may accommodate multiple large diameter casings capable of providing access to and fluid communication with conventionally inaccessible annuli. Accessibility to such annuli allows for improved scaling capability and the installation of testable barriers within the annuli. Increased annuli sealing capability helps to prevent the inadvertent release of formation fluids (e.g., hydrocarbons, produced water, etc.) from the wellbore to the atmosphere. Additionally, prevention of shallow hazard influxes into the wellbore may be improved. Lastly, the wellheads disclosed herein may be operable to withstand potential thermal growth (thermal expansion) that can occur when the well is put on production and, therefore, subject to changing (fluctuating) internal temperatures. This disclosure further describes a contingency landing joint to be used when the primary methods of wellhead installation are not feasible.

FIG. 1 is a partial cross-sectional side view of an example well system 100 that may employ one or more principles of the present disclosure, according to one or more embodiments. The well system 100 may be similar in some respects to the wellhead systems shown and described in U.S. Pat. No. 11,396,785, which issued on Jul. 26, 2022, the contents of which are hereby incorporated by reference in their entirety. Where differences are not mentioned, it is to be understood that the specifics of the wellhead systems of U.S. Pat. No. 11,396,785 are applicable to the well system 100 described herein.

FIG. 1 depicts a portion of the well system 100 in its completed state. As illustrated, the well system 100 includes a wellhead installation 102 positioned on a terrancan surface 104 and extending over and around a wellbore 105 that penetrates a subterranean formation 106. In some applications, the well system 100 may be constructed as a land-based operation, but it will be appreciated that the principles of the present disclosure could equally be applied in any offshore, sea-based, or sub-sea application where the wellhead installation 102 may be arranged on a floating platform, a semi-submersible platform, or may comprise a sub-surface wellhead installation, as generally known in the art.

As illustrated, the wellhead installation 102 may include a low pressure wellhead 108 starter system (hereinafter referred to as the "LPWH 108") that may be installed during the initial construction of the wellbore 105, a casing head housing and one or more casing spools that may be subsequently installed as the wellbore 105 is extended to deeper depths. As illustrated, the wellhead installation 102 includes a casing head housing 110*a* arranged atop the LPWH 108, and a casing spool 110*b* arranged atop the casing head housing 110*a*. Upon reaching the final desirable depth of the wellbore 105, the wellhead installation 102 may include subsequent casing spools (fluidly coupled to associated extensions of casing) and a tubing head housing (not shown) mounted atop the casing spool 110*b*, and fluidly coupled to an extension of production tubing (not shown) that may extend into the wellbore 105 for the purposes of producing hydrocarbons. Because the purpose of the present disclosure relates to components comprising the lower-most and first installed portions of the wellhead installation 102, the tubing head housing and associated tubing is not shown nor will either component be discussed in any detail.

Figure 2:
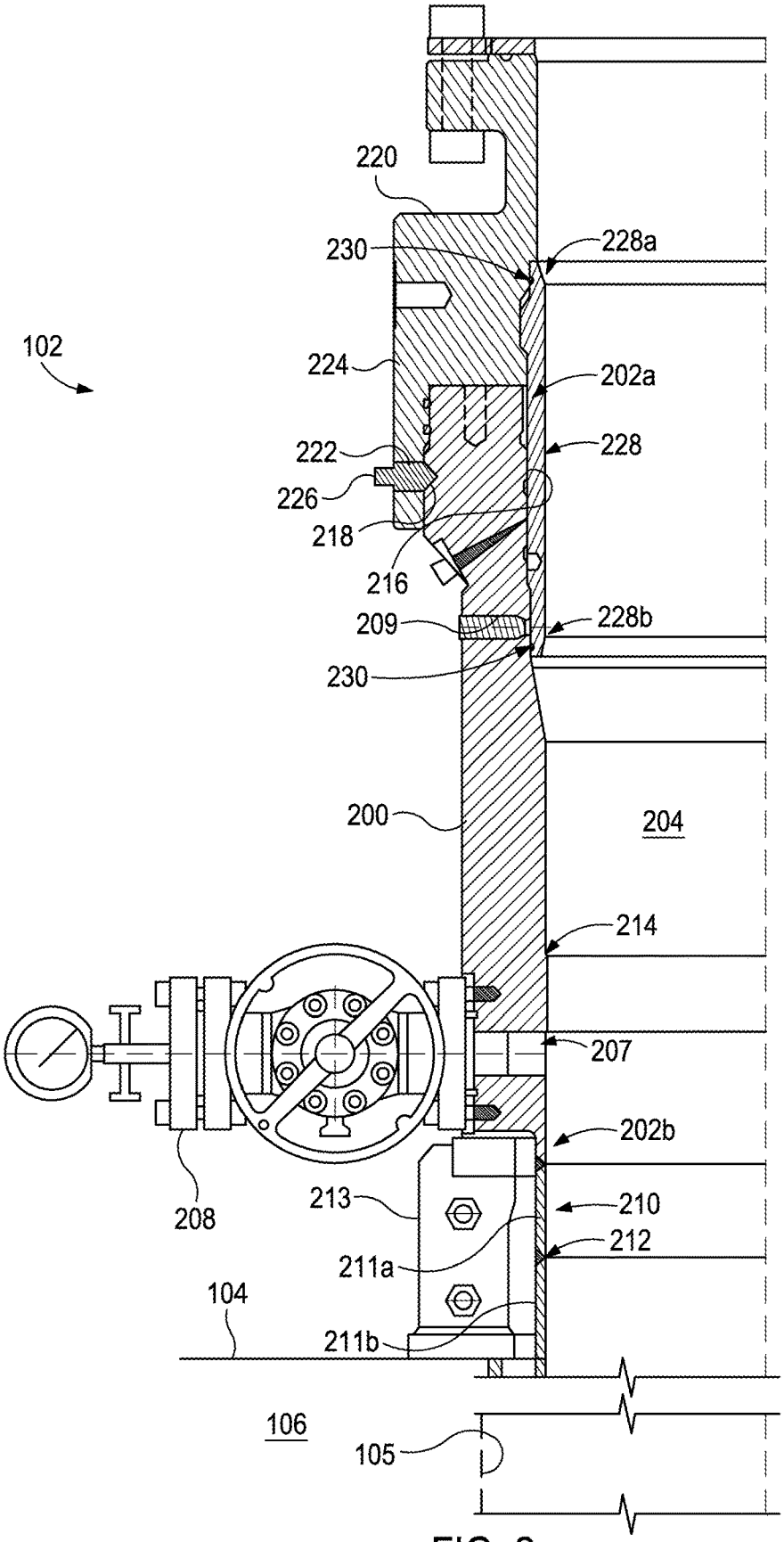
FIG. 2 is an enlarged, schematic side view of an example low pressure surface wellhead housing starter system, according to one or more embodiments of the disclosure.
Figure 3:
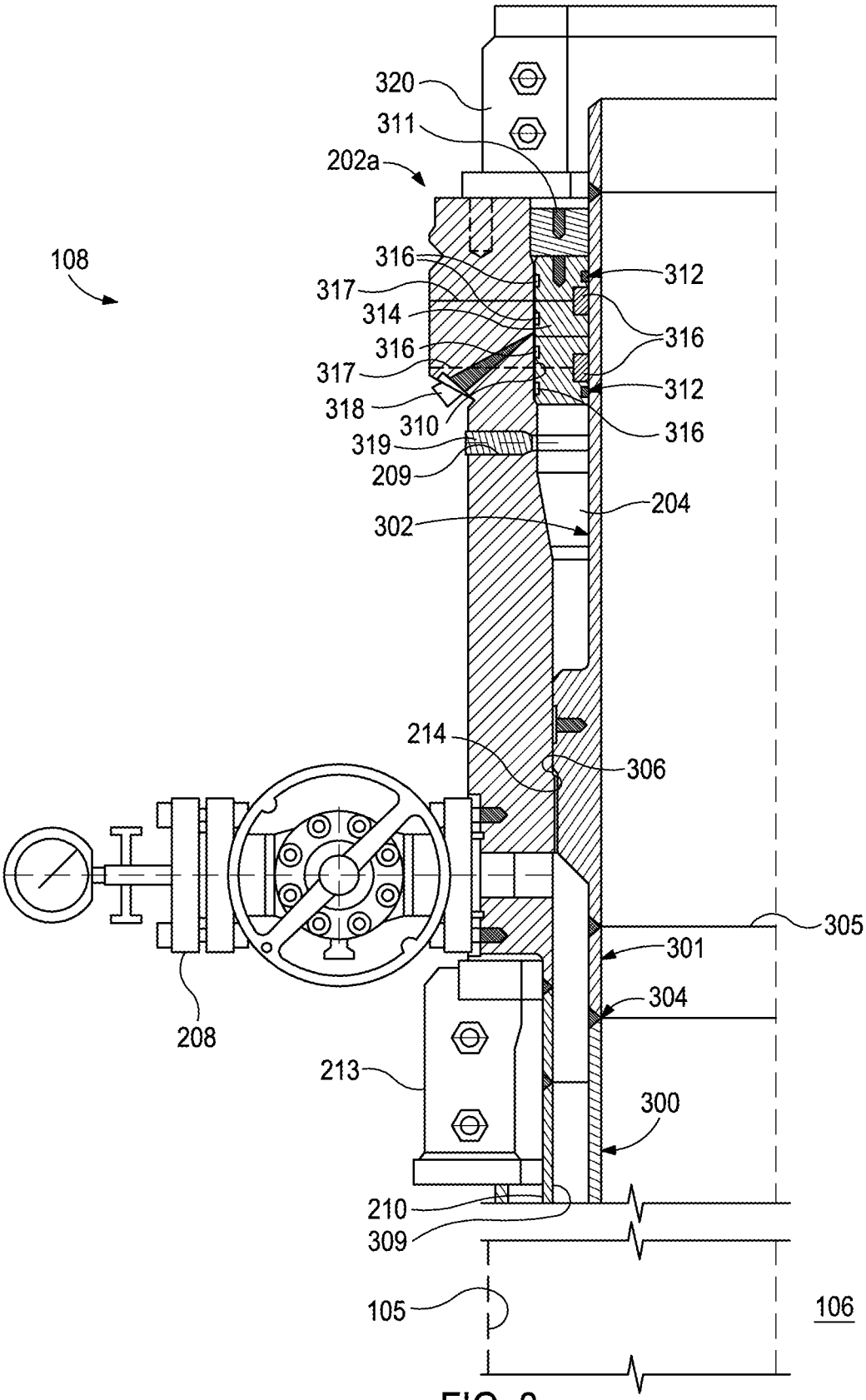
FIG. 3 is an enlarged, schematic side view of an example casing hanger received by the low pressure surface wellhead starter system of FIG. 2, according to one or more embodiments of the disclosure.

FIGS. 2 and 3 are enlarged schematic side views of the wellhead installation 102 depicting progressive operational steps in the construction of the wellbore 105 and the wellhead installation 102, according to one or more embodiments of the present disclosure Referring first to FIG. 2, a partial cross-sectional side view of one example of the LPWH 108 is illustrated. As illustrated, the LPWH 108 includes a housing providing a generally cylindrical hollow body 200 having an upper end 202*a* and a lower end 202*b* opposite the upper end 202*a*. The body 200 defines an internal through-bore 204 that extends between the upper and lower ends 202*a,b* of the LPWH 108 and constitutes the interior and inner radial surfaces of the body 200. The internal through-bore 204 may be configured so as to allow the passage of casings, tubing, drill pipe, and/or any downhole tools, therethrough for the construction of the wellbore 105.

As illustrated, two or more fluid outlets 207 (only one shown due to partial cross-sectional view) may be defined through a sidewall of the body 200 to facilitate fluid communication between the internal through-bore 204 and the external environment. The LPWH 108 may further include two or more gate valves 208 (only one shown due to partial cross-sectional view) operatively coupled to the body 200 to regulate fluid flow in and out of the internal through-bore 204 via the fluid outlets 207. The gate valves 208 may be operable to relieve pressure within the internal through-bore 204 and/or introduce or extract fluids. The example disclosed herein utilizes at least two gate valves 208 in fluid communication with a corresponding at least two fluid outlets 207, which provides redundancy and better fluid circulation. In at least one embodiment, each of the fluid outlets 207 may include a threaded profile defined with the interior of the fluid outlets 207 and operable to receive a plug. The plug sized to be secured within the respective fluid outlet(s) 207 may include an external profile operable to theadingly engage the threaded profiles of the fluid outlets 207. The plug may be installed as a pressure containing barrier to facilitate replacement of the gate valves 208 or otherwise.

The LPWH 108 may further include one or more orifices 209 defined through the side wall of the body 200. The orifices 209 may be configured to receive, via interference fit, threading, or otherwise, various components sized and operable for various required operations. Examples of such components include, but are not limited to, blind plugs, retention screws or lock down screws.

The wellhead installation 102 may further include one or more conductors (large diameter casings or otherwise) secured to and extending into the wellbore 105 below the LPWH 108. In the illustrated embodiment, a conductor 210 may be attached to bottom of the LPWH 108, such as via welding to the bottom of the body 200. The conductor 210 may include an upper conductor (or a pup joint) 211*a* and a lower conductor 211*b* welded to the upper conductor 211*a* at a connection point 212. In another embodiment, the body 200 of the LPWH 108 may provide or otherwise define a lower recessed profile sized and operable to receive and secure an extension of conductor, drive pipe or other large diameter casing.

The conductor 210 may be generally operable to prevent potential cave-in of the unconsolidated sediment generally present in shallow formations. In conventional well construction operations, the conductor is typically driven, hammered or jet to a predetermined depth below surface 104 so that some amount of conductor may visibly extend above the surface 104. The portion of exposed conductor left above surface 104 is generally circumferentially cut (by any known means) to provide a level surface for a base plate 213 that may be subsequently mounted atop the cut portion of the conductor. The base plate 213 provides load support for the subsequent wellhead housings to be installed as the well system 100 and the wellhead installation 102 is progressively constructed. The conventional configuration prevents the conductor from having any fluid communication (or otherwise) with the rest of the wellhead installation 102. Further, the installation of the base plate limits any future access to the annulus that is created by the interior of the conductor and exterior of any immediately subsequent casing string.

According to embodiments of the present disclosure, the LPWH 108 may constitute an improvement over conventional wellhead installations by providing a means of communication between the wellhead installation 102 and a conductor casing. More importantly, the embodiments disclosed herein provide the ability to ensure sealing integrity between the interior body of the conductor 210 and the immediately subsequent casing string that arranged within the conductor 210. Such a configuration thus prevents potential fluid influx from the shallow formation 106 into the wellbore 105 and similarly, in the alternative direction, prevents the potential release of formation fluids (or otherwise) from the wellbore 105 to the atmosphere when the wellbore 105 is put on production and likely subject to thermal expansion.

Similar to conventional installations briefly discussed above, the lower conductor 211*b* may be initially driven, hammered or jet into place to a predetermined (or otherwise) distance below the surface 104. A portion of the lower conductor 211*b* (the most upper portion, relative to the end of the wellbore 105) may remain exposed above the surface 104. In contrast to conventional operations requiring the installation of a baseplate, the upper end of the upper conductor 211*a* may first be secured to the bottom of the LPWH 108, such as by welding, following which the lower end of the upper conductor 211*a* may be secured to the exposed upper end of the lower conductor 211*b*, such as by welding at the connection point 212. Welding and post-weld heat treatment processes of the upper conductor 211*a* to the LPWH 108 may be accomplished before the LPWH 108 is delivered to the well site and otherwise off the critical path. As used herein, the term "critical path" or "critical path time" refers to the ability to maximize the time spent drilling and extending the well to its total depth while attempting to minimize the time spent on well construction or other activities. A reduction in critical path time allows the well to be put on production as soon as possible.

Accordingly, in a step not shown and performed off the critical path, the upper conductor 211*a* may be welded to the LPWH 108, such as welded to the lower end 202*b*. In other embodiments, the upper conductor 211*a* may be operatively coupled to the LPWH 108 in a variety of other known means of mating/coupling. As used herein, the term "operatively couple" and variations thereof refers to a direct or indirect coupling engagement between two components. Once secured to the LPWH 108, in any embodiment, a portion of the upper conductor 211*a* extends below and past the lower end 202*b* of the LPWH 108.

In at least one embodiment, the upper conductor 211*a* may be secured to the LPWH 108 at an offsite location other than the location of the wellbore 105. In other embodiments, the upper conductor 211*a* may be operatively coupled to the LPWH 108 at the wellbore 105 location but similarly, off critical path. In yet other embodiments, the coupling of the upper conductor 211*a* to the LPWH 108 may occur at the wellbore 105 location and similarly on the critical path. Accordingly, the location and/or timing of the joining of the upper conductor 211*a* to the LPWH 108 is not considered to be limiting to the scope of this disclosure. In addition, and for the purposes of time savings and efficiency, the two or more gate valves 208 may be operatively coupled to the LPWH 108 off the critical path and similarly at any location the operator finds operationally desirable. In yet another embodiment, there may be not designation of the upper conductor 211*a* or lower conductor 211*b*, such that a single extension (or extensions) of conductor may be positioned some distance below surface 104. In such an embodiment, the LPWH 108 may be secured to the uppermost exposed portion of the LPWH 108 by any known means.

In the example embodiment disclosed herein, when feasible and/or procedurally necessary, the LPWH 108 including the one or more gate valves 208 and the upper conductor 211*a*, may be operatively coupled to the upper portion of the lower conductor 211*b* extending above the surface 104. As indicated above, the upper and lower conductors 211*a,b* may welded together at the connection point 212, but may alternatively be coupled (secured together) by any known method or means.

The LPWH 108 may also include a load shoulder 214 defined within the interior body 200 (e.g., within the internal through-bore 204). As discussed in more detail below, the load shoulder 214 may be configured to receive and land a casing hanger 302 (FIG. 3) operatively coupled to a subsequent casing string to be arranged concentrically within the body 200 and the conductor 210. The LPWH 108 may further include an upper recessed profile 216 defined within the body 200 (e.g., within the internal through-bore 204) at or near the upper end 202*a* of the LPWH 108. The upper recessed profile 216 may be operable to receive a sealing device to be installed once the aforementioned casing hanger has been set within the LPWH 108 and the casing string extended into the wellbore 105.

A quick connect profile 218 may be defined or otherwise provided on the exterior of the body 200 of the LPWH 108 at or near the upper end 202*a*. The quick connect profile 218 may extend circumferentially about the exterior of the upper end 202*a* of the LPWH 108 and may be operable to receive a matable member disposed within (or operatively coupled to) an additional wellhead installation 102 component. Additional wellhead installation 102 components include, for example, an adapter, a diverter, a riser and any combination thereof.

In the illustrated embodiment, a retrievable diverter adapter 220 is operatively coupled to the LPWH 108 at the quick connect profile 218. The diverter adapter 220 may be installed for well control purposes to enable the make-up of a riser or diverter (not shown) atop the diverter adapter 220 and thus enable drilling operations to deepen the wellbore 105 before it is operationally feasible to install a blowout preventer (BOP). Accordingly, the diverter adapter 220 may be temporarily included within the wellhead installation 102 so that drilling operations and well construction may commence as necessary.

The diverter adapter 220 may extend circumferentially about the upper end 202*a* of the LPWH 108 when the diverter adapter 220 is lowered into setting position. During installation, the diverter adapter 220 may be lowered until the quick connect profile 218 axially aligns with one or more fastener apertures 222 defined within and through a side wall 224 of the diverter adapter 220. The fastener aperture(s) 222 may be sized and configured to receive one or more fasteners 226, which are operable to secure the diverter adapter 220 to the LPWH 108 via the quick connect profile 218.

In at least one embodiment, the diverter adapter 220 may also include a bowl protector 228 sized to be received within the LPWH 108 at or near the upper end 202*a*. The bowl protector 228 is operable to protect upper portions of the internal through-bore 204 during drilling operations, thereby preventing damage to internal surfaces of the internal through-bore 204 that may be subsequently be used as sealing surfaces.

As illustrated, the bowl protector 228 includes opposing upper and lower ends 228*a* and 228*b*, wherein the upper end 228*a* is configured to be received within the interior of the diverter adapter 220 and the lower end 228*b* is configured to be received within the internal through-bore 204. One or more elements 230 (two shown; e.g., upper and lower elements) may be arranged in the interface (cavity) between the bowl protector 228 and the inner surfaces of the diverter adapter 220 and the internal through-bore 204. The elements 230 may be operable to prevent foreign material and formation cuttings from entering the cavity and thereby may prevent degradation of the interface (cavity) that will later serve as a scaling profile. In at least one embodiment, the elements 230 may be comprised of an elastomeric material, but could alternatively comprise other types of materials.

In the example assembly, the bowl protector 228 and the diverter adapter 220 may be received and set with the LPWH 108 in a single trip, and may be subsequently removed from the LPWH 108 in a single trip during retrieval. Such integration is advantageous over traditional operations where installation of a discrete bowl protector and diverter may require a minimum of two trips into and out of the LPWH 108.

In some embodiments, a riser adapter (not shown) may be installed atop the diverter adapter 220. In any embodiment, the operator may configure the wellhead installation 102 during the wellbore 105 construction operation in accordance with the needs and requirements of the wellbore 105. Accordingly, the particular wellhead installation 102 configuration illustrated in FIG. 2 is not considered to limit the scope of the invention disclosed herein.

Once the diverter adapter 220 and the integral bowl protector 228 arc operatively coupled to the LPWH 108, the wellbore 105 may be drilled to a deeper depth within the formation 106 so that upon reaching a depth (pre-determined or otherwise) a subsequent casing string may be extended into the wellbore 105 via the LPWH 108. Upon completion of the operations requiring the use of the diverter adapter 220 and the bowl protector 228 (e.g., drilling, or in some embodiments, the running and cementing of a casing string), the diverter adapter 220 and the bowl protector 228 may be removed from the LPWH 108.

FIG. 3 illustrates the next procedural step in accordance with the example well construction and wellhead installation 102 operations disclosed herein. More particularly, FIG. 3 illustrates a string of casing 300 that may be positioned within the wellbore 105 following removal of the diverter adapter 220 (FIG. 2).

The string of casing 300 may be operatively coupled to a casing hanger 302 wherein the casing hanger 302 may further include a casing extension 301 arranged below the casing hanger 302. The casing hanger 302 may be extended into and through the internal through-bore 204 of the LPWH 108. The casing hanger 302 may be generally cylindrical in shape, configured to be received within the LPWH 108. The casing extension 301 may be operatively coupled to and positioned below the casing hanger 302. The casing extension 301 may be generally cylindrical shape and may comprise an outer diameter the same or substantially similar to the outer diameter of the casing hanger 302 and the string of casing 300. The casing hanger 302 may be operatively coupled to the casing extension 301 at a connection point 304 by means of welding operation. Accordingly, at its lower end, the casing hanger 302 may include a weld-joint profile 305 to engage a corresponding weld-joint profile 305 defined within the upper end of the casing extension 301. In at least one embodiment, the casing hanger 302 may be welded to the casing extension 301 at an offsite location other than the location of the wellbore 105. In another embodiment, the casing hanger 302 may be welded to the casing extension 301 at the wellbore 105 location but similarly, off critical path. In yet another embodiment, the casing hanger 302 may be coupled to the casing extension 301 at the wellbore 105 location and but on the critical path. Accordingly, the location and/or timing of the joining of the casing hanger 302 to the casing extension 301 is not considered to be limiting to the scope of this disclosure.

In another embodiment, the casing hanger 302 may be operatively coupled to the casing extension 301 via threaded engagement or similar. Accordingly, at its lower end, the casing hanger 302 may include threads (not shown) configured to threadably engage a corresponding threaded profile (not shown) defined within the upper end of the casing extension 301. In yet another embodiment, the casing extension 301 may be eliminated entirely such that the casing hanger 302 may be directly coupled to the string of casing 300.

In any embodiment, the lower end of the casing extension 301 may be operatively coupled to the upper end of the string of casing 300 via threaded engagement. When operationally desirable, the string of casing 300, the casing extension 301, and the casing hanger 302 may be extended into the internal through-bore 204. The string of casing 300 may be extended further into the wellbore 105 to a depth that allows the casing hanger 302 to land within the LPWH 108. In at least one embodiment, the distal end of the casing 300 may be positioned at or near the deepest point of the newly drilled section of wellbore 105 as the casing hanger 302 lands within the LPWH 108. In another embodiment, the casing 300 may be positioned such that its distal end terminates a predetermined distance above the deepest point of the wellbore 105.

In at least one embodiment, the exterior (outer diameter) of the casing hanger 302 may be clad with a corrosion-resistant alloy to enhance the durability and corrosion-resistant properties of the casing hanger 302. Cladding the exterior of the casing hanger 302 may help maintain the surface condition of the casing hanger 302 over time as the casing hanger 302 becomes subject to corrosion from produced water, hydrocarbons, and other corrosion-generating fluids. The corrosion-resistant alloy may simultaneously help to ensure durability of a scaling device to be installed once the casing hanger 302 is positioned within the LPWH 108. The corrosion-resistant alloy helps to ensure the pressure integrity of the well system 100 throughout its lifecycle as the casing hanger 302 gradually raises and lower due to thermal cycles. In at least one embodiment the corrosion-resistant alloy may be Inconel 625. In other embodiments, the corrosion-resistant alloy may comprise any material operable to resist corrosion and compatible with the well system 100.

As best seen in the enlarged view provided in FIG. 3, a hanger shoulder 306 may be defined about the outer surface of the casing hanger 302, and may be sized to locate and land on the load shoulder 214 when the string of casing 300 is extended into the wellbore 105. The hanger shoulder 306 may exhibit a diameter greater than that of the load shoulder 214, and thus the casing 300 is hung from the LPWH 108 at the load shoulder 214.

As illustrated, the load shoulder 214 may be located axially above (uphole from) the gate valves 208. In a previous design iteration (as disclosed in U.S. Pat. No. 11,396,785) the load shoulder 214 is positioned below the side outlet valves 207 and similarly, the gate valves 208. According to embodiments of the present disclosure, however, positioning the load shoulder 214 above the gate valves 208 allows each annulus within the wellbore 105 to be independent of the previous section (annulus) once a sealing device is installed. In the example embodiment disclosed herein, an annulus 309 defined by the interior of the conductor 210 and the exterior of the casing 300. Further, the position of load shoulder 214 above the gate valves 208 prevents the buildup of debris and/or circulation fluid across the load shoulder 214. Wherein the debris and/or fluid may be present due to fluid return and/or circulation operations through the gate valves 208.

Once the casing hanger 302 is properly positioned, a sealing area 310 is created above the load shoulder 214. More particularly, the scaling area 310 may comprise an annular space defined above the load shoulder 214 and between the exterior of the casing hanger 302 and the interior of the upper end 202*a* of the LPWH 108. Debris, like that which is mentioned above, may similarly be present within the sealing area 310 as a result of drilling operation and fluid circulation from the wellbore 105 prior to installing the casing 300.

A sealing device 314 may be positioned within the sealing area 310. In some embodiments, a circumferential sealing device 314 may be arranged about the outer surface of the casing hanger 302. The sealing device 314 may be operable to prevent the influx or release of formation fluids. The sealing device 314 may further ensure the integrity of the barrier and/or seal above the load shoulder 214. As illustrated, the scaling device 314 includes one or more sealing elements 316 positioned on the internal and external diameter of the scaling device 314, which may generate a sealed interface between the exterior of the scaling device 314 and the inner radial surface (inner wall) of the LPWH 108 as well as between the interior of the sealing device 314 and the exterior of the casing hanger 302.

After the casing 300 and the casing hanger 302 are lowered into the LPWH 108, the sealing device 314 may be lowered into the LPWH 108. The sealing device 314 may further include a set of wiper seals 312 that may be disposed circumferentially about the sealing device 314. As the scaling device 314 is lowered into position, the wiper seals 312 may be operable to remove or expunge the aforementioned debris, drilling fluid, and/or other unwanted fluid/matter that may be present with the sealing area 310 as the sealing device 314 is lowered into place. Similarly, the wiper seals 312 may be operable for debris removal in instances when the casing hanger 302 and the casing 300 may be subject to axial movement due to thermal expansion of the casing.

In some embodiments, the sealing device 314 may include one or more injection ports 317 operable to re-energize the sealing elements if and/or when the integrity of the sealing device 314 deteriorates. The injection ports 317 extend through the sealing element 314 and into respective seal grooves that secure one the sealing elements 316 adjacent the exterior of the casing hanger 302. In such an embodiment, the LPWH 108 includes through holes that correspond to the injection ports 317 thereby allowing injection from the exterior of the LPWH 108. In some embodiments, the injection ports 317 may also be used to test the integrity of the sealing device 314 and the sealed interface within the internal through-bore 204. The sealing device 314 may further include dedicated test ports and/or fittings 318 that enable confirmation of the seal integrity of the system (sealing component, casing hanger/casing, and LPWH). The fittings 318 may comprise check valves and/or pressure-boundary fittings that enable pumping of test fluid.

The sealing device 314, alternatively referred to as a "packoff," may comprise any known device/element capable of securing and/or sealing the space above the load shoulder 214. Generally, the sealing device 314 comprises a metal body including sealing elements made of or including an elastomeric material, but the scope of this disclosure is not limited elastomers and should not be construed as such. As a result of its material composition and the corrosion-resistant alloy surface finish of the casing hanger 302 and casing 300, the sealing device 314 may be capable of withstanding the growth (axial movement) that may occur within the wellhead installation 102 as a result of thermal expansion. Accordingly, the sealing device 314 is operable to maintain sealing integrity throughout the life of the wellbore 105 and may ultimately prevent the inadvertent release of fluids from the interior of the wellbore 105 to the atmosphere via the annulus 309.

Once the casing hanger 302 is landed within the LPWH 108 and sealing device 314 is installed and secured in place, with a lock nut 311, fluid communication between above and below the sealing device 314 is subsequently prevented or cut off. The sealing device 314 is thus operable as a barrier to prevent an outflow of fluid from a shallow hazard (e.g., shallow gas, shallow water flow, etc.) that may be located within the formation 106 from being released to the environment.

Once the casing hanger 302 is positioned and secured within the interior of the LPWH 108, one or more blind plugs 319 (only one shown) may be installed within the orifices 209 of the LPWH 108. As illustrated, the fittings 318 axially interpose the scaling device(s) 314 and the load shoulder 214. In some embodiments, the fittings 318 may also be operable to maintain the integrity of the seal in the space above the load shoulder 214. Accordingly, the scaling device 314, the sealing elements 316 and the fittings 318 are independently and in combination, testable barriers operable to assist in preventing both the potential influx of fluids from the formation 106, and may further help prevent the inadvertent release of fluids from the interior of the wellbore 105 to the atmosphere via the annulus 309.

The wellhead installation 102 depicted in FIG. 3 further includes a base plate 320. When operationally feasible, and once the scaling device 314 is set and tested as necessary and/or required, the base plate 320 may be positioned atop the LPWH 108. The base plate 320 may be operable to receive a casing head housing 110*a* (FIG. 1) that may be subsequently set once an additional section of the wellbore 105 has been drilled and cased. In other embodiments, at this point in the operation, the casing head housing 110*a* may be installed without the support of the base plate 320.

Figure 4:
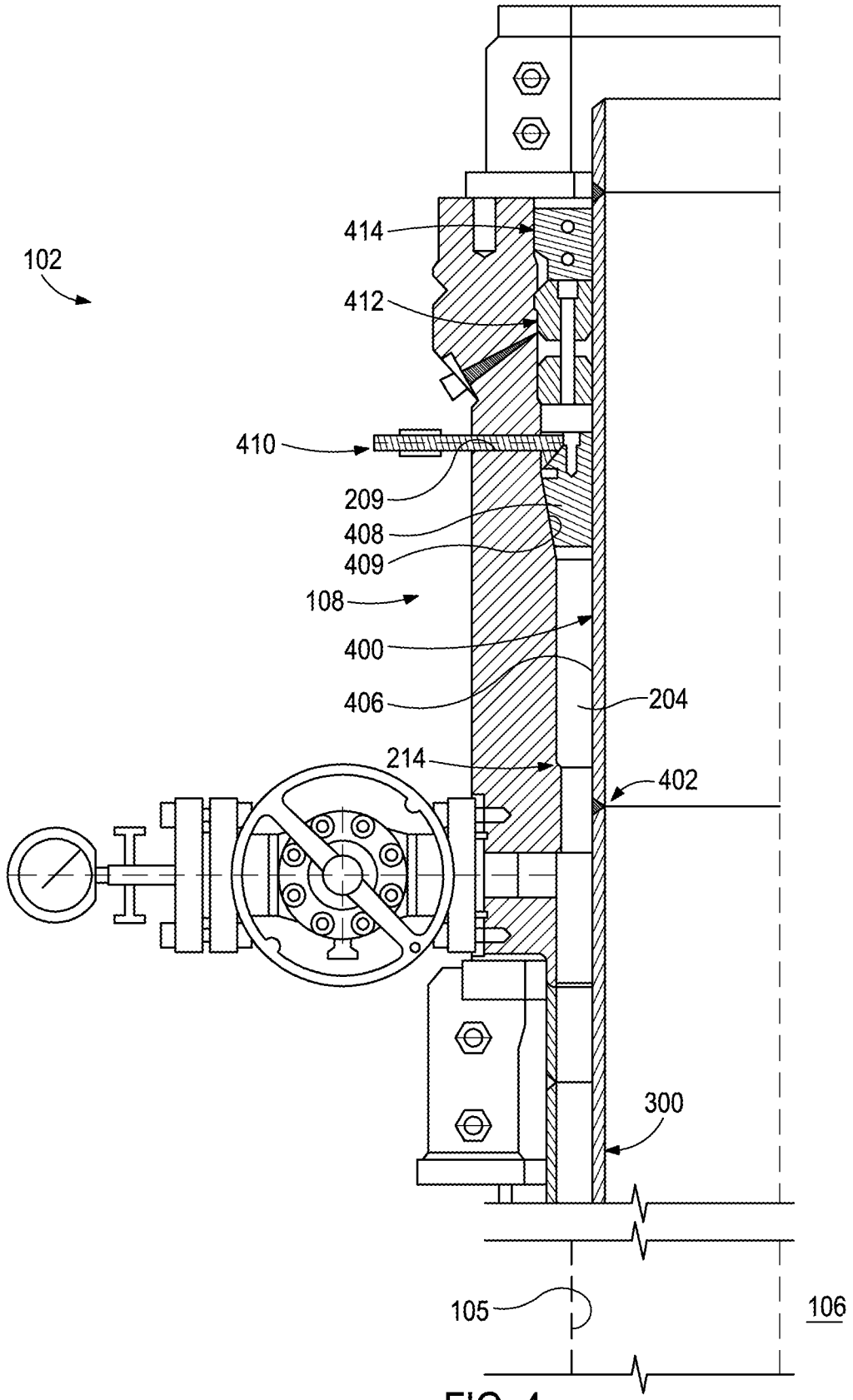
FIG. 4 is a schematic side view of an example contingency landing joint received by the low pressure surface wellhead starter system of FIGS. 2-3, according to one or more embodiments of the disclosure.

FIG. 4 is another enlarged, schematic side-view diagram of the wellhead installation 102, according to one or more embodiments. In particular, FIG. 4 illustrates the wellhead installation 102 during a contingency casing running operation. In some instances while the operation may have been planned, the casing 300 may not extend to its predetermined and/or planned depth within the wellbore 105. For example, the casing 300 space out may not have been calculated correctly, or the casing 300 may not have been able to be run as planned due to the configuration (geometry) of the wellbore 105. As a result, the casing hanger 302 (FIG. 3) operatively coupled to the casing extension 301 and the casing 300 may no longer be able to properly land within the LPWH 108. In such applications, use of a contingency landing joint 400 may be required to locate the casing 300 the proper distance within the wellbore 105.

To be able to use the contingency landing joint 400, the casing hanger 302 (FIG. 3) may be removed (disengaged from) the casing 300, by cutting or unthreading the connection point 304 (FIG. 3). In some embodiments, and depending upon the depth at which the casing 300 is no longer able to extend into the wellbore 105, the casing hanger 302, in addition to some portion of the casing 300, may have to be fully disengaged, at a point below the connection point 304 and removed from the wellbore 105 entirely. In such an embodiment, disengagement may be accomplished via operations that include but are not limited to, backing out the respective threaded engagements as well as cutting and/or severing.

With the casing hanger 302 disengaged (removed) from the upper end of the casing 300 and/or the casing extension 301 (not shown), the contingency landing joint 400 may be operatively coupled to the upper end of the casing 300 at a connection point 402. In most embodiments, the top of the casing 300 may comprise a cut or a weld profile. Accordingly, the contingency landing joint 400 may be welded to the cut portion of the casing 300. In other embodiments, the connection point 402 may comprise a threaded engagement between the casing 300 and the contingency landing joint 400. Once coupled, the casing 300 and the contingency landing joint 400 may be lowered within the LPWH 108 so that the contingency landing joint 400 may be received by and secured within the LPWH 108.

The contingency landing joint 400 may include a generally cylindrical body 406 that may be clad with a corrosion-resistant alloy. The corrosion-resistant alloy may assist in maintaining the surface condition of the contingency landing joint. In contrast to the casing hanger 302 (FIG. 3), the contingency landing joint 400 does not include a shoulder (e.g., the hanger shoulder 306) capable of landing on the load shoulder 214 of the conductor 211*a,b*. A centralizer ring 408 may be installed to help center the contingency landing joint 400 and the casing 300 within the internal through-bore 204 of the LPWH 108. Keeping the contingency landing joint center will help to prolong the durability of the sealing elements of the scaling device. Moreover, the centralizer ring 408 may be configured to locate and be received on a tapered shoulder 409 defined within the internal through-bore 204 axially uphole from the load shoulder 214.

Once the contingency landing joint 400 is lowered into the LPWH 108, the centralizer ring 408 may be installed. The centralizer ring 408 may be lowered into the LPWH and above the exterior of the contingency landing joint 400, until it lands the shoulder 409.

In at least one embodiment, the centralizer ring 408 may be secured in place via one or more lockdown screws 410. The lockdown screws 410 may be configured to be received within the orifices 209. Once the centralizer ring 408 is properly positioned within the LPWH 108, the lockdown screws 410 may be installed to secure the centralizer ring 408 in place. In other embodiments, the centralizer ring 408 may be held in place by any known means.

Following the installation of the contingency landing joint 400 and the centralizer ring 408, a split sealing element 412 may be installed above the lock down screws 410 within the annular sealing area 310. The split scaling element 412 may be operable to maintain pressure and scaling integrity between the contingency landing string and the LPWH (and the annulus 309 below), and helps prevent the potential outflow of wellbore 105 fluids (that may include fluids originating from the formation 106) to the environment. Similarly, the sealing element 412 may prevent an influx of fluids from shallow hazards that may be positioned within the formation 106, from entering the annulus 309. The split sealing element 412 may extend circumferentially about the body 406 of the contingency landing joint 400. The sealing element 412 may be similar in composition to that of the sealing device 314 (FIG. 3). The split sealing element 412 may installed via a running tool on a separate run into the wellbore 105.

Similar to the centralizer ring 408, the split sealing element 412 may be secured and held in place via the installation of a split lock ring 414. In the contingency landing joint 400 operation, the split lock ring 414 includes the same functionality as the lock nut 311 (FIG. 3) previously described. The split lock ring 414 may be configured to be received within the LPWH 108 and arranged atop (axially uphole from) the split sealing element 412. The split lock ring 414 may be operable to secure the split sealing element 412 in place and prevent axial movement of the split sealing element 412 in the event that the wellbore 105 experiences thermal expansion when the wellbore 105 is put on production. The split lock ring 414 may be similar in composition to the lock nut 311 (FIG. 3).

Figure 5:
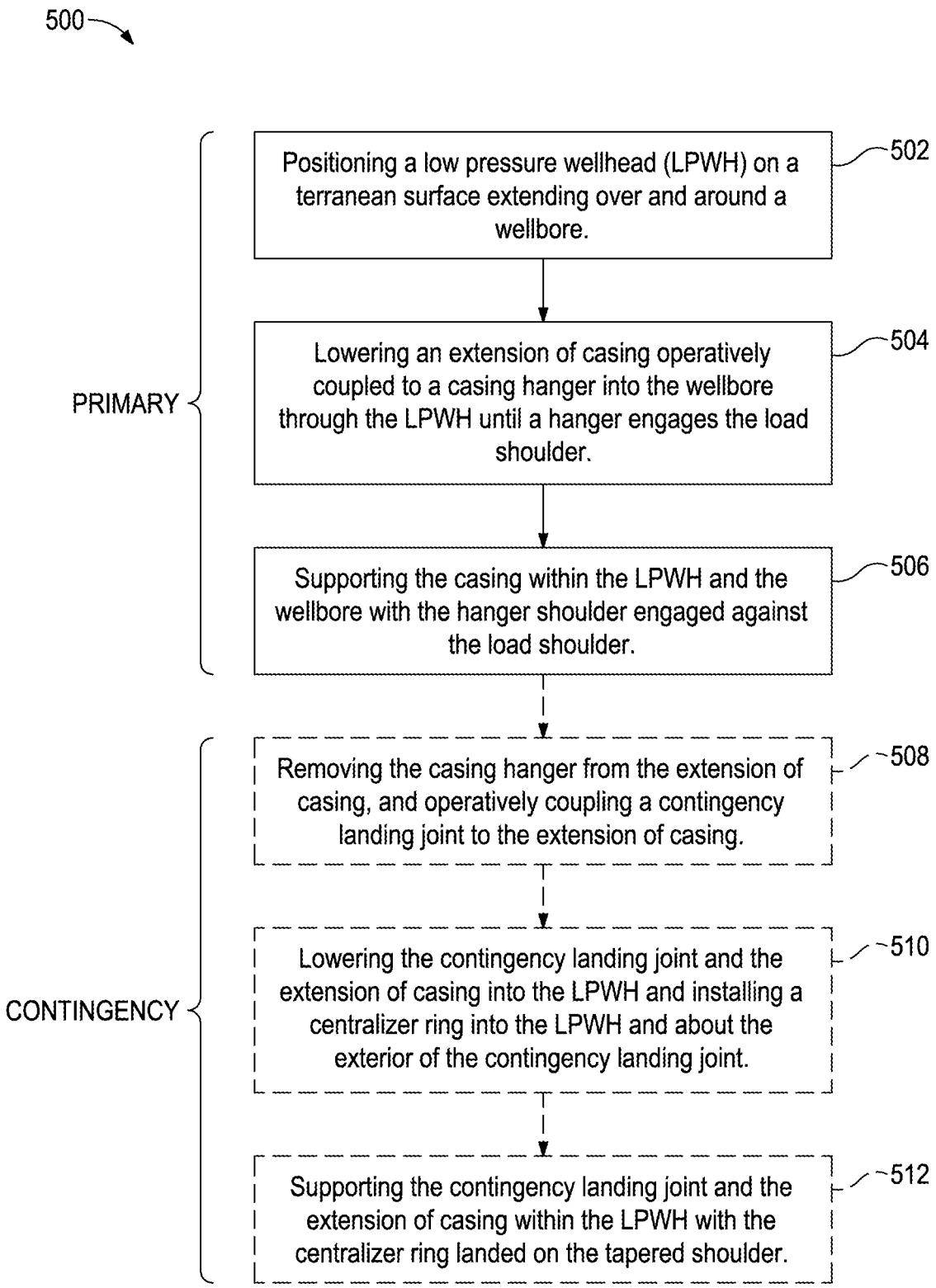
FIG. 5 is a flow chart illustration of an example method of installing a wellhead installation, according to the principles of the present disclosure.

FIG. 5 is a flow chart illustration of an example method 500 of installing a wellhead installation, according to the principles of the present disclosure. The method 500 may be best understood with reference to FIGS. 1-4 provided herein. As illustrated, the method 500 may include positioning a low pressure wellhead (LPWH) on a terranean surface extending over and around a wellbore penetrating a subterranean formation, as at 502. The LPWH may include a body having opposing upper and lower ends, and an internal through-bore defined within the body and extending between the upper and lower ends. Two or more fluid outlets may be defined through a sidewall of the body to facilitate fluid communication with the internal through-bore, and a load shoulder may be defined within the internal through-bore axially uphole from the two or more fluid outlets. An extension of large diameter casing (conductor) may be operatively coupled to and below the end of the LPWH.

The method 500 may further include lowering an extension of casing operatively coupled to a casing hanger and a casing extension into the wellbore through the LPWH until a hanger shoulder defined on the casing hanger engages the load shoulder, as at 504, and supporting the casing within the LPWH and the wellbore with the hanger shoulder engaged against the load shoulder, as at 506. Once landed within the LPWH, a sealing device may be positioned and secured within the LPWH to ensure pressure and scaling integrity between the interior of the conductor and the exterior of the casing.

As discussed above, in some applications the extension of casing may not extend to a predetermined and/or planned depth within the wellbore. As a result, the casing hanger may not be able to properly land within the LPWH, as provided in steps 504 and 506 above. In such applications, the method 500 may optionally include removing the casing hanger from the extension of casing, and operatively coupling a contingency landing joint to the extension of casing, as at 508. The contingency landing joint and the extension of casing may then be lowered into the LPWH. A centralizer ring may be arranged about an exterior of the contingency landing joint once the contingency landing joint is positioned within the LPWH, the centralizer ring may engage a tapered shoulder of the LPWH, as at 510. The method 500 may then further include supporting the contingency landing joint and the extension of casing within the LPWH with the centralizer ring landed on the tapered shoulder, as at 512. The contingency landing joint installation method may continue in accordance with the procedural steps disclosed above.

Embodiments disclosed herein include:

A. A well system, the system including a wellbore penetrating a subterrancan formation and a wellhead installation positioned above and extending over the wellbore. The wellhead installation including a low pressure wellhead (LPWH) providing a body having opposing upper and lower ends and an internal through-bore defined within the body and extending between the upper and lower ends with two or more fluid outlets defined through a sidewall of the body to facilitate fluid communication with the internal through-bore and a load shoulder defined within the internal through-bore axially uphole from the two or more fluid outlets. The well system also including a conductor casing secured the lower end of the body of the LPWH and a casing hanger operatively coupled to an extension of casing extending concentrically within the conductor and into the wellbore in which the casing hanger defining a hanger shoulder is engageable with the load shoulder when the casing hanger is lowered into the LPWH.

B. A well system, the system including a wellbore penetrating a subterrancan formation, a wellhead installation positioned above and extending over the wellbore. The wellhead installation including a low pressure wellhead (LPWH) providing a body having opposing upper and lower ends and an internal through-bore defined within the body and extending between the upper and lower ends, two or more fluid outlets defined through a sidewall of the body to facilitate fluid communication with the internal through-bore and a load shoulder defined within the internal through-bore axially uphole from the two or more fluid outlets. The LPWH body further including a tapered shoulder defined within the internal through-bore axially uphole from the load shoulder. The well system further include a conductor casing secured the lower end of the body of the LPWH, a contingency landing joint operatively coupled to an extension of casing extending concentrically within the conductor and into the wellbore, and a centralizer ring arranged about an exterior of the contingency landing joint and engageable with the tapered shoulder, wherein landing the centralizer ring on the tapered shoulder supports the contingency landing joint and the extension of casing within the LPWH.

C. A method of installing a wellhead installation, the method including positioning a low pressure wellhead (LPWH) on a terranean surface extending over and around a wellbore penetrating a subterranean formation. The LPWH including a body having opposing upper and lower ends and an internal through-bore defined within the body and extending between the upper and lower ends as well as two or more fluid outlets defined through a sidewall of the body to facilitate fluid communication with the internal through-bore and a load shoulder defined within the internal through-bore axially uphole from the two or more fluid outlets. The method further including lowering an extension of casing operatively coupled to a casing hanger into the wellbore through the LPWH until a hanger shoulder defined on the casing hanger engages the load shoulder and supporting the casing within the LPWH and the wellbore with the hanger shoulder engaged against the load shoulder.

Each of embodiments A, B, and C may have one or more of the following additional elements in any combination: Element 1: wherein the wellhead installation further includes two or more gate valves operatively coupled to the body and in fluid communication with a corresponding one of the two or more fluid outlets, the two or more gate valves being operable to regulate fluid flow in and out of the internal through-bore via the two or more fluid outlets. Element 2: the well system further comprising an upper recessed profile defined within the internal through-bore at or near the upper end; a retrievable diverter adapter operatively coupled to the LPWH at the upper end; and a bowl protector having opposing upper and lower ends, the upper end of the bowl protector being received within an interior of the retrievable diverter adapter, and the lower end of the bowl protector being received within the internal through-bore at the upper recessed profile. Element 3: the well system further comprising an upper element arranged to prevent the degradation of the interface between the upper end of the bowl protector and the interior of the retrievable diverter adapter; and a lower element arranged to prevent the degradation of the interface between the lower end of the bowl protector and the upper recessed profile. Element 4: wherein an exterior of the casing hanger is clad with a corrosion-resistant alloy. Element 5: the well system further comprising: an annular scaling area provided above the load shoulder and defined between an exterior of the casing hanger and an inner wall of the internal through-bore; and a circumferential sealing device arranged within the annular sealing area including one or more sealing elements operable to generate a sealed interface between the exterior of the casing hanger and the inner wall of the internal through-bore. Element 6: the well system further comprising one or more wiper seals arranged on the circumferential scaling device and engageable with the exterior of the casing hanger. Element 7: the well system further comprising one or more orifices defined in a sidewall of the body and facilitating fluid communication with the annular sealing area; and one or more blind plugs receivable within a corresponding one of the one or more orifices.

Element 8: wherein the contingency landing joint is clad with a corrosion-resistant alloy. Element 9: the well system further comprising: an annular scaling area provided above the load shoulder and defined between an exterior of the contingency landing joint and an inner wall of the internal through-bore; one or more orifices defined in a sidewall of the body at the annular sealing area; and one or more lockdown screws receivable within a corresponding one of the one or more orifices to secure the centralizer ring in place. Element 10: a split sealing element installed within the annular sealing area axially above centralizer ring; and a split lock ring arranged within the annular sealing area axially above the split scaling element.

Element 11: wherein positioning the LPWH on the terranean surface is preceded by: securing an upper portion of a conductor to the lower end of the body of the LPWH; driving a lower portion of the conductor into the wellbore; and welding the upper portion to the lower portion. Element 12: wherein the wellhead installation further includes two or more gate valves operatively coupled to the body and in fluid communication with a corresponding one of the two or more fluid outlets, the method further comprising regulating fluid flow in and out of the internal through-bore axially below the load shoulder using the two or more gate valves. Element 13: wherein the LPWH further includes an upper recessed profile defined within the internal through-bore at or near the upper end, and wherein lowering the extension of casing operatively coupled to the casing hanger into the wellbore is preceded by: mounting a bowl protector within an interior of a retrievable diverter, the bowl protector including opposing upper and lower ends, and the upper end of the bowl protector being received within the interior of the retrievable diverter adapter; mounting the retrievable diverter to the LPWH at the upper end and thereby receiving the lower end of the bowl protector within the internal through-bore at the upper recessed profile; drilling the wellbore to a deeper depth through the LPWH; and removing the retrievable diverter and the bowl protector from the LPWH once drilling is complete. Element 14: generating a first sealed interface between the upper end of the bowl protector and the interior of the retrievable diverter adapter with an upper sealing element; and generating a second sealed interface between the lower end of the bowl protector and the upper recessed profile with a lower sealing element. Element 15: wherein an annular sealing area is provided above the load shoulder and defined between an exterior of the casing hanger and an inner wall of the internal through-bore, the method further comprising: arranging a circumferential scaling device within the annular sealing area; generating a sealed interface between the exterior of the casing hanger and the inner wall of the internal through-bore with one or more sealing elements included in the circumferential sealing device. Element 16: wherein the LPWH further includes a tapered shoulder defined within the internal through-bore axially uphole from the load shoulder, the method further comprising: removing the casing hanger from the extension of casing; operatively coupling a contingency landing joint to the extension of casing; lowering the contingency landing joint and the extension of casing into the LPWH until a centralizer ring arranged about an exterior of the contingency landing joint engages the tapered shoulder; and supporting the contingency landing joint and the extension of casing within the LPWH with the centralizer ring landed on the tapered shoulder. Element 17: wherein an annular sealing area is provided above the load shoulder and defined between an exterior of the casing landing joint and an inner wall of the internal through-bore, the method further comprising: securing the centralizer ring in place by extending one or more lockdown screws into a corresponding one or more orifices defined in a sidewall of the body at the annular scaling area; and generating a sealed interface within the annular scaling area axially above centralizer ring with a split sealing element installed within the annular sealing area.

By way of non-limiting example, exemplary combinations applicable to A, B and C include: Element 2 with Element 3; Element 5 with Element 6; Element 5 with Element 7; Element 9 with Element 10; and Element 13 with Element 14.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Use of directional terms such as above, below, upper, lower, upward, downward, uphole, downhole, and the like are used in relation to the illustrative embodiments as they are depicted in the figures, the upward or uphole direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A well system, comprising:

a wellhead installation positioned above and extending over a wellbore, the wellhead installation including:

a low pressure wellhead (LPWH) providing a body having opposing upper and lower ends, and an internal through-bore defined within the body and extending between the upper and lower ends;

an upper recessed profile defined within the internal through-bore at or near the upper end;

a retrievable diverter adapter operatively coupled to the LPWH at the upper end;

a bowl protector having opposing upper and lower ends, the upper end of the bowl protector being received within an interior of the retrievable diverter adapter, and the lower end of the bowl protector being received within the internal through-bore at the upper recessed profile;

two or more fluid outlets defined through a sidewall of the body to facilitate fluid communication with the internal through-bore; and a load shoulder defined within the internal through-bore axially uphole from the two or more fluid outlets;

conductor casing secured the lower end of the body of the LPWH; and a casing hanger operatively coupled to an extension of casing extending concentrically within the conductor and into the wellbore, the casing hanger defining a hanger shoulder engageable with the load shoulder when the casing hanger is lowered into the LPWH.

2. The well system of claim 1, wherein the wellhead installation further includes two or more gate valves operatively coupled to the body and in fluid communication with a corresponding one of the two or more fluid outlets, the two or more gate valves being operable to regulate fluid flow in and out of the internal through-bore via the two or more fluid outlets.

3. The well system of claim 1, further comprising:

an upper element arranged to prevent the degradation of the interface between the upper end of the bowl protector and the interior of the retrievable diverter adapter; and a lower element arranged to prevent the degradation of the interface between the lower end of the bowl protector and the upper recessed profile.

4. The well system of claim 1, wherein an exterior of the casing hanger is clad with a corrosion-resistant alloy.

5. The well system of claim 1, further comprising:

an annular sealing area provided above the load shoulder and defined between an exterior of the casing hanger and an inner wall of the internal through-bore; and a circumferential sealing device arranged within the annular sealing area including one or more sealing elements operable to generate a sealed interface between the exterior of the casing hanger and the inner wall of the internal through-bore.

6. The well system of claim 5, further comprising one or more wiper seals arranged on the circumferential sealing device and engageable with the exterior of the casing hanger.

7. The well system of claim 5, further comprising:

one or more orifices defined in a sidewall of the body and facilitating fluid communication with the annular sealing area; and one or more blind plugs receivable within a corresponding one of the one or more orifices.

8. A well system, comprising:

a wellhead installation positioned above and extending over a wellbore, the wellhead installation including:

a low pressure wellhead (LPWH) providing a body having opposing upper and lower ends, and an internal through-bore defined within the body and extending between the upper and lower ends;

two or more fluid outlets defined through a sidewall of the body to facilitate fluid communication with the internal through-bore;

a load shoulder defined within the internal through-bore axially uphole from the two or more fluid outlets; and a tapered shoulder defined within the internal through-bore axially uphole from the load shoulder;

conductor casing secured the lower end of the body of the LPWH;

a contingency landing joint operatively coupled to an extension of casing extending concentrically within the conductor and into the wellbore; and a centralizer ring arranged about an exterior of the contingency landing joint and engageable with the tapered shoulder, wherein landing the centralizer ring on the tapered shoulder supports the contingency landing joint and the extension of casing within the LPWH.

9. The well system of claim 8, wherein the contingency landing joint is clad with a corrosion-resistant alloy.

10. The well system of claim 8, further comprising:

an annular sealing area provided above the load shoulder and defined between an exterior of the contingency landing joint and an inner wall of the internal through-bore;

one or more orifices defined in a sidewall of the body at the annular sealing area; and one or more lockdown screws receivable within a corresponding one of the one or more orifices to secure the centralizer ring in place.

11. The well system of claim 10, further comprising:

a split sealing element installed within the annular sealing area axially above centralizer ring; and a split lock ring arranged within the annular sealing area axially above the split sealing element.

12. A method of installing a wellhead installation, comprising positioning a low pressure wellhead (LPWH) on a terranean surface extending over and around a wellbore penetrating a subterranean formation, the LPWH including:

a body having opposing upper and lower ends, and an internal through-bore defined within the body and extending between the upper and lower ends;

two or more fluid outlets defined through a sidewall of the body to facilitate fluid communication with the internal through-bore; and a load shoulder defined within the internal through-bore axially uphole from the two or more fluid outlets, wherein an annular sealing area is provided above the load shoulder and defined between an exterior of the casing hanger and an inner wall of the internal through-bore;

lowering an extension of casing operatively coupled to a casing hanger into the wellbore through the LPWH until a hanger shoulder defined on the casing hanger engages the load shoulder;

supporting the casing within the LPWH and the wellbore with the hanger shoulder engaged against the load shoulder;

arranging a circumferential sealing device within the annular sealing area;

generating a sealed interface between the exterior of the casing hanger and the inner wall of the internal through-bore with one or more sealing elements included in the circumferential sealing device.

13. The method of claim 12, wherein positioning the LPWH on the terranean surface is preceded by:

securing an upper portion of a conductor to the lower end of the body of the LPWH;

driving a lower portion of the conductor into the wellbore; and welding the upper portion to the lower portion.

14. The method of claim 12, wherein the wellhead installation further includes two or more gate valves operatively coupled to the body and in fluid communication with a corresponding one of the two or more fluid outlets, the method further comprising regulating fluid flow in and out of the internal through-bore axially below the load shoulder using the two or more gate valves.

15. The method of claim 12, wherein the LPWH further includes an upper recessed profile defined within the internal through-bore at or near the upper end, and wherein lowering the extension of casing operatively coupled to the casing hanger into the wellbore is preceded by:

mounting a bowl protector within an interior of a retrievable diverter, the bowl protector including opposing upper and lower ends, and the upper end of the bowl protector being received within the interior of the retrievable diverter adapter;

mounting the retrievable diverter to the LPWH at the upper end and thereby receiving the lower end of the bowl protector within the internal through-bore at the upper recessed profile;

drilling the wellbore to a deeper depth through the LPWH; and removing the retrievable diverter and the bowl protector from the LPWH once drilling is complete.

16. The method of claim 15, further comprising:

generating a first sealed interface between the upper end of the bowl protector and the interior of the retrievable diverter adapter with an upper sealing element; and generating a second sealed interface between the lower end of the bowl protector and the upper recessed profile with a lower sealing element.

17. The method of claim 12, wherein the LPWH further includes a tapered shoulder defined within the internal through-bore axially uphole from the load shoulder, the method further comprising:

removing the casing hanger from the extension of casing;

operatively coupling a contingency landing joint to the extension of casing;

lowering the contingency landing joint and the extension of casing into the LPWH until a centralizer ring arranged about an exterior of the contingency landing joint engages the tapered shoulder; and supporting the contingency landing joint and the extension of casing within the LPWH with the centralizer ring landed on the tapered shoulder.

18. The method of claim 17, the method further comprising:

securing the centralizer ring in place by extending one or more lockdown screws into a corresponding one or more orifices defined in a sidewall of the body at the annular sealing area; and generating a sealed interface within the annular sealing area axially above centralizer ring with a split sealing element installed within the annular sealing area.

* * * * *